United States Patent [19]

Gröbler et al.

[11] Patent Number: 4,667,598

[45] Date of Patent: May 26, 1987

[54] METHOD AND APPARATUS FOR DETECTING DIFFERENT DETONATING CONDITIONS FOR A FOLLOW-UP CHARGE

[75] Inventors: Peter Gröbler, Hochstadt; Norbert Nibl, Aresing, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 854,987

[22] Filed: Apr. 22, 1986

Related U.S. Application Data

[62] Division of Ser. No. 662,089, Oct. 18, 1984.

[30] Foreign Application Priority Data

Oct. 26, 1983 [DE] Fed. Rep. of Germany ..... 3338784

[51] Int. Cl.[4] ..... F42C 11/00; F42C 19/06

[52] U.S. Cl. ..... 102/215; 102/216; 102/262; 200/61.45 R

[58] Field of Search ..... 102/206, 210, 215, 216, 102/262, 363, 397, 476; 200/52 R, 61.45 R, 61.53, 61.58 R

[56] References Cited

U.S. PATENT DOCUMENTS

| | | | |
|---|---|---|---|
| 2,804,823 | 9/1957 | Jablansky | 102/476 |
| 3,109,373 | 11/1963 | Saffer, Jr. | 102/476 |
| 4,112,844 | 9/1984 | Held et al. | 102/19.2 |
| 4,421,030 | 12/1983 | Dekoker | 102/476 |
| 4,567,829 | 2/1986 | Ziemba et al. | 102/216 |
| 4,574,168 | 3/1986 | Devaney | 102/262 |

FOREIGN PATENT DOCUMENTS

| | | |
|---|---|---|
| 1811331 | 7/1977 | Fed. Rep. of Germany . |
| 2207557 | 11/1982 | Fed. Rep. of Germany . |

*Primary Examiner*—Charles T. Jordan

*Attorney, Agent, or Firm*—W. G. Fasse; D. H. Kane, Jr.

[57] ABSTRACT

The conditions for detonating a follow-up charge in a dual stage weapon are detected for detonating the follow-up charge either instantaneously or after a time delay. An instantaneous detonation is caused when the dual stage weapon should not penetrate sufficiently through a target surface or when the weapon rebounds. A delayed detonation is intended when the dual stage weapon has penetrated a target. The delayed detonation shall be responsive, preferably randomly, to an approach to the weapon. This type of control of the weapon detonation in response to different detonating conditions is accomplished by using two, preferably three acceleration or vibration sensors producing signals which are evaluated for determining the respective detonating condition.

15 Claims, 7 Drawing Figures

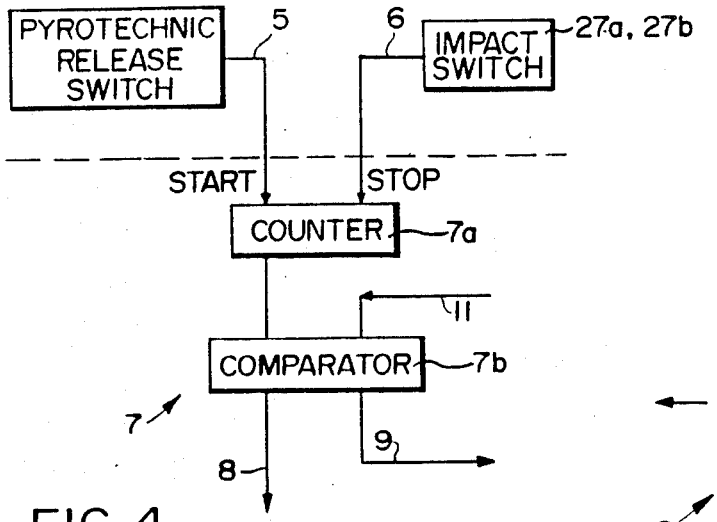
FIG. 4
FIG. 3
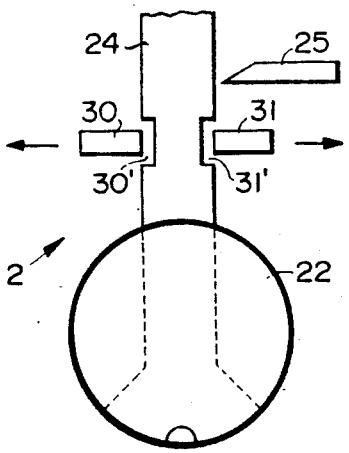
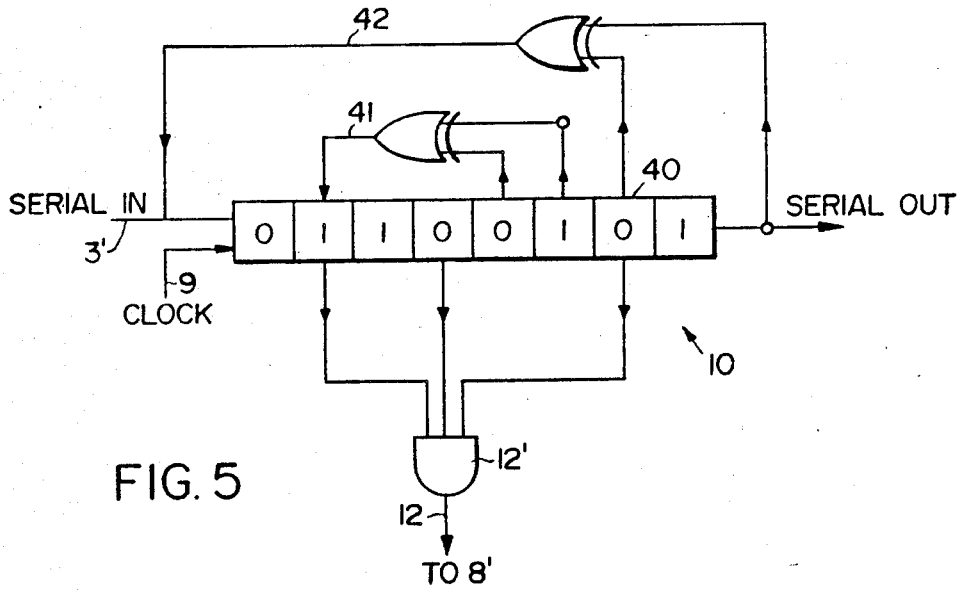
FIG. 5

METHOD AND APPARATUS FOR DETECTING DIFFERENT DETONATING CONDITIONS FOR A FOLLOW-UP CHARGE

This is a divisional of application Ser. No. 662,089, filed Oct. 18, 1984.

FIELD OF THE INVENTION

The invention relates to a method and apparatus or system for detecting different detonating conditions for a follow-up charge in a dual stage weapon containing a primary explosive charge and the follow-up explosive charge. Sensors, especially acceleration sensors are used to provide signals to be evaluated for determining the respective detonating condition.

DESCRIPTION OF THE PRIOR ART

A dual stage weapon comprises a primary explosive charge for enabling the weapon to penetrate a target surface and a follow-up explosive charge intended to explode under certain conditions prevailing at or in the target. Sensors, especially acceleration sensors, are used for determining the environmental conditions at or in the target after the primary explosive charge, for example a hollow explosive charge, in a dual stage or tandem weapon has already exploded. These weapons may include bombs to be dropped, shells or rockets or the like which are constructed to first penetrate a target surface such as an airport runway, or the wall of a target such as a tank, a submarine, a fortification or the like. The follow-up explosive charge is then supposed to detonate inside the target or underneath the runway surface.

Especially in connection with bombs constructed for destroying runways and highway surfaces, it is important for a maximum destructive effect that the primary explosive charge enables the bomb to penetrate through the surface and that the follow-up explosive charge is detonated in response to certain detonating conditions. Thus, it is important, for example, to determine whether the follow-up explosive charge has remained stuck in the target wall or whether it has rebounded from the target surface. These conditions are determined with the aid of sensors, the output signals of which are suitably combined to produce a detonating signal for the follow-up explosive charge. Rebounding or getting stuck by the weapon may depend on the dynamic conditions to which the weapon is exposed once it has contacted the target. Gas dynamic conditions may be involved as well as dynamic conditions caused by the respective environment such as the runway or the like. For example, when the local dynamic conditions cause the weapon to rebound, the follow-up explosive charge shall be detonated instantly. On the other hand, when the bomb gets stuck in the runway the follow-up explosive charge shall be placed or switched into a lurking state which will only be terminated when the weapon in its lurking stage is approached or driven over at which time it is to explode.

In the just described environmental it has been a problem heretofore to provide the sensors capable of meeting the requirements. Such sensors must be compatible with a very rapid and highly precise signal processing to make sure that the proper time is detected when the weapon, for example, begins to rebound. The accelerations occurring under these conditions are very large and prior art acceleration sensors are not only very expensive, they are also not precise enough under these very large accelerations.

Prior art acceleration sensors are either constructed for measuring high acceleration, in which case they do not have a very large measuring sensitivity or rather precision. On the other hand, acceleration sensors having the required measuring precision or sensitivity are capable of sensing only relatively small accelerations. If such highly sensitive prior art acceleration sensors for measuring small accelerations are temporarily exposed to higher accelerations or even shock type accelerations, these prior art sensors are either temporarily or permanently incapacitated.

OBJECTS OF THE INVENTION

In view of the foregoing, it is the aim of the invention to achieve the following objects singly or in combination:

to provide a method and system which is capable of determining the proper detonating condition for a follow-up charge in a tandem or dual stage weapon depending on the instantaneously prevailing operating situation of the weapon;

to provide an acceleration sensor which is simple in its structure and inexpensive to manufacture, yet capable of detecting the proper detonating condition out of several possible detonating conditions, whereby the sensor shall precisely differentiate between a rebounding situation and the situation where the weapon got stuck in a surface, the sensor shall be precise over a wide accleration range; and the present system shall also be able to recognize an approach to the weapon, for example, by personnel intending to remove the weapon or by a vehicle or aircraft driving over the weapon which got stuck.

SUMMARY OF THE INVENTION

The present method and system detects the detonating conditions for a follow-up charge in a tandem or dual stage weapon with the aid of acceleration sensors which provide output signals to a logic circuit connected to the detonator of the follow-up charge. According to the system and method of the invention a first acceleration sensor, having a low sensitivity and which is not locked when the dual stage weapon is fired, dropped, or launched, releases with its output signal, after an adjustable time delay, a locking member of a second initially locked acceleration sensor having a high sensitivity. Then the output signal of the second now unlocked acceleration sensor is used as a time reference or time criterion for determining the type of activation of the follow-up charge. The output signal of the second highly sensitive acceleration sensor may be evaluated together with the output signals of one or more additional acceleration sensors which may provide its signal or their signals through a random function generator.

The above mentioned second acceleration sensor according to the invention has a high sensitivity over a wide range of accelerations and comprises housing means forming a cavity having a central axis defining a sensing direction, accleration sensing mass means, mounting means releasably mounting said sensing mass means in said cavity of said housing means, releasing means operatively arranged for cooperation with said mounting means for releasing said sensing mass means for movement in said cavity of said housing means in said sensing direction upon release of said sensing mass means, and switch means operatively arranged in said housing means in a position for actuation of said switch means by said sensing mass means after said sensing mass means has moved through a predetermined distance in said sensing direction in said cavity.

BRIEF DESCRIPTION OF THE DRAWINGS

In order that the invention may be clearly understood, it will now be described, by way of example, with reference to the acompanying drawings, wherein:

FIG. 3 shows the sensing mass of the acceleration sensor of FIG. 2 with a sequential two stage release of the acceleration mass following the dropping, firing, or launching of a weapon equipped with such a sensor;

FIG. 4 is a block diagram of a discriminator or detector suitable for use in the circuit of FIG. 1;

FIG. 5 is a circuit diagram for a random function generator for use in the circuit of FIG. 1;

DETAILED DESCRIPTION OF PREFERRED EXAMPLE EMBODIMENTS AND OF THE BEST MODE OF THE INVENTION

Figure 1:
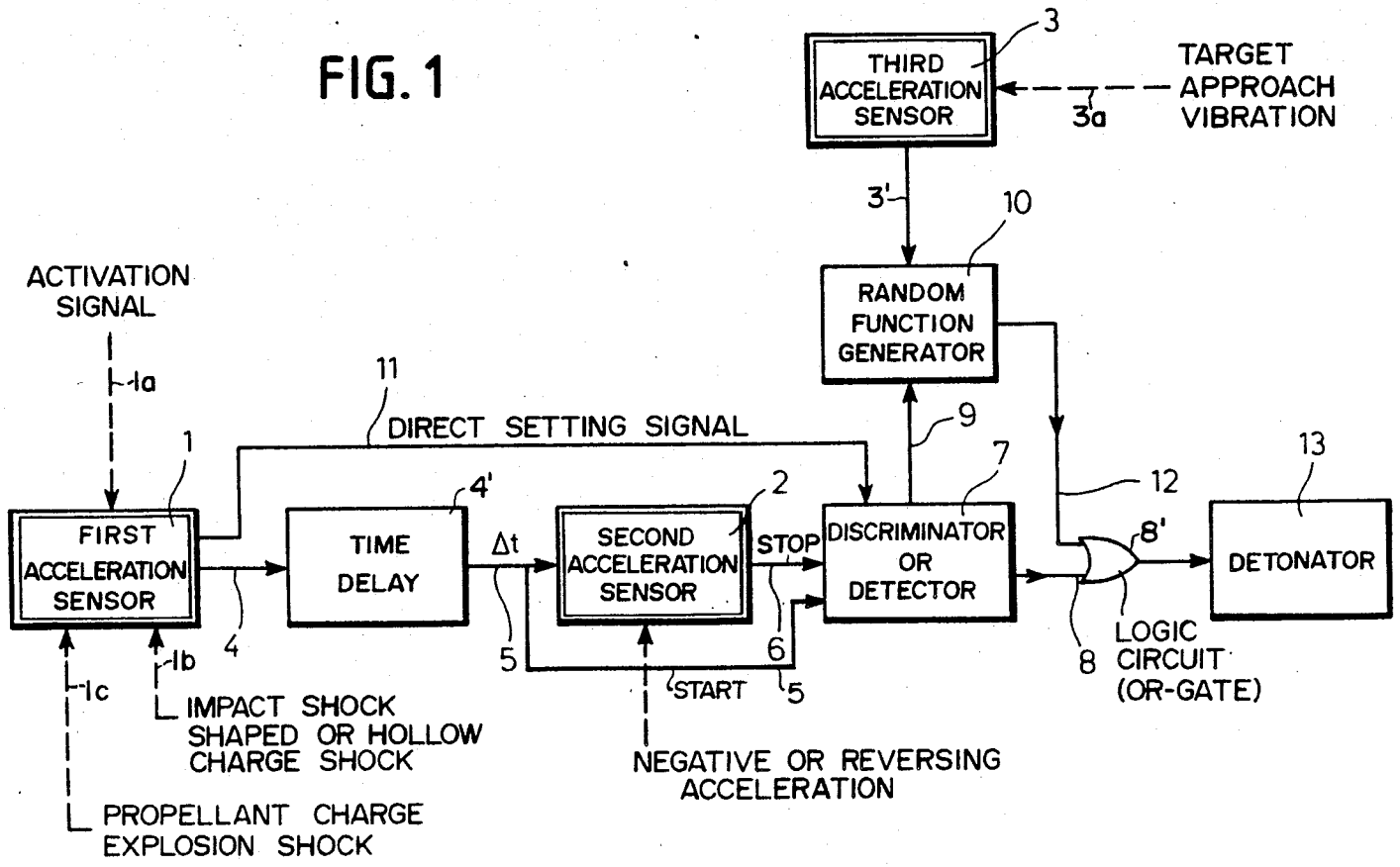
FIG. 1 is a block circuit diagram of the present system for detecting different detonating conditions for a follow-up charge in a dual stage weapon.

The block circuit diagram of FIG. 1 illustrates a system detecting different detonating conditions for a follow-up charge by performing the method disclosed herein. A dual stage weapon for example, a bomb of which only the detonator 13 is shown in FIG. 1, is activated or "made live" by conventional means on board of the delivery device such as an aircraft. such activating involves providing an electrical current impulse to the weapon which also activates the power supply of the follow-up charge. Auxiliary capacitors in the power supply of the follow-up charge and the power supply of the follow-up charge are activated by charging these capacitors and by activating, for example, by pyrotechnical means a thermal battery forming conventionally part of the power supply of the follow-up charge.

The present system comprises a first acceleration sensor device 1 for example, in the form of a conventional piezo-electric sensor with its respective electrical circuit. The first acceleration sensor 1 receives the above mentioned activation signal just prior to or at the time of releasing a bomb as indicated by the arrow 1*a*. The first acceleration sensor 1 senses an impact shock when the weapon hits the target and its also senses the explosion of a hollow or so-called shaped charge forming the primary explosive charge of the weapon. This is indicated by the input arrow 1*b*. The input arrow 1*c* represents an input to the first acceleration sensor 1 which is provided, for example, when the weapon is a rocket and its propellant charge explodes. The first acceleration sensor 1 has only a relatively low vibration sensitivity and is constructed without any locking means so that its response is available immediately upon activation of the weapon.

The first accleration sensor 1 produces a first output signal 4 which is supplied through a time delay device 4' such as an RC network to provide a delayed first output signal 5 which is available after a time delay $\Delta t$ after the occurrence of the output signal 4. The delayed first output signal 5 is supplied to a second acceleration sensor 2 for activating the latter for example, by exploding a charge 26 as will be described in more detail below with reference to FIG. 2 which also shows the details of the second acceleration sensor 2.

Referring further to FIG. 1, the second acceleration sensor 2 is constructed to sense a negative or reversing acceleration when the weapon should rebound, whereby the sensor 2 produces an output signal 6 which is supplied through the conductor 6' (FIG. 2) to a discriminator or detector circuit 7. If there is no rebounding, the first acceleration sensor 1 also provides a second output signal 11 which is supplied as a direct setting signal to a further input of the discriminator or detector circuit 7.

The size or any other criterion of the output signal 6 is used for determining or detecting the applicable release or triggering condition for the detonator 13. If there is a rebounding signal provided by the sensor 2, the discriminator provides an instantaneous output signal 8 which is supplied through a logic OR-gate 8' to the detonator 13 of the weapon which is thus instantly detonated as a rebounding occurs.

On the other hand, if no rebounding occurs, the detector 7 determines that the weapon is to be placed into a "lurking" state for detonation at a random later time or in response to a further acceleration or vibration signal 3' provided by a third acceleration sensor 3. The arrow 3*a* into the sensor 3 signifies that this sensor picks up target approach vibrations, for example, when a vehicle or aircraft rolls over the weapon or when personnel approaches the weapon for removal.

The random function generator 10 is provided to make a removal of the weapon more difficult. For this purpose the random function generator 10 receives at one of its inputs the signal 3' from the third acceleration sensor 3 and at another input the generator 10 receives the signal 9 from the discriminator or detector 7 signifying a lurking condition as mentioned above. The random function generator 10 provides a random function activating signal 12 which is also supplied through the OR-gate 8' to the detonator 13. Additionally, the random function generator 10 may be constructed to provide the random activating signal 12 independently of any input from the third acceleration sensor 3 and thus independently of any approach vibrations. Thus, the random function generator 10 may also operate as a random time delay for the detonating of the weapon when a lurking condition has been determined or detected.

Incidentally, the third vibration sensor 3 shown in FIG. 1 may also be embodied by a piezo-electric vibration sensor of conventional construction. Therefore, a more detailed disclosure of the third sensor 3 is not provided.

Figure 2:
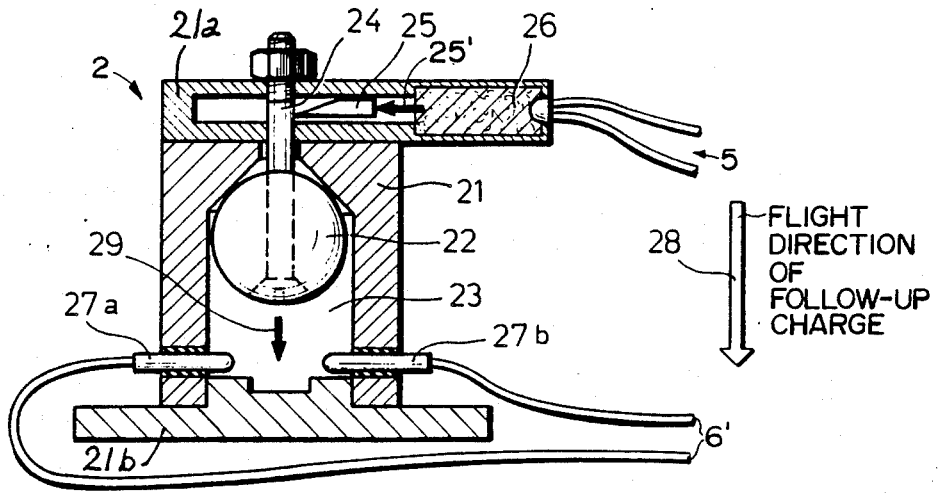
FIG. 2 is a sectional view through an acceleration sensor according to the invention having a high sensitivity of a wide range of accelerations, and suitable for use as the so-called second acceleration sensor as disclosed herein.

FIG. 2 shows an embodiment suitable for use as the second vibration sensor 2 in FIG. 1. The vibration sensor 2 comprises a housing 21 forming a cavity 23 having a central axis defining a sensing direction as indicated by the arrow 29. An acceleration sensing means mass 22 is releasably mounted inside the cavity 23 by a releasable mounting member such as a screw 24 which may be released by a releasing device including a cutter 25 which severs the screw 24 in response to a force 25' generated when the explosive charge 26 is ignited by a signal 5 from the time delay device 4'. When the mass 22 is free to move in the cavity 23 in the direction of the arrow 29 due to the severing of the screw 24, the movement of the mass 22 is dependent on the acceleration to which the follow-up charge is exposed, such as a rebounding acceleration. In response to such rebounding acceleration the ball 22, after a certain travel or falling time in the cavity 23 will close the contacts 27*a*, 27*b* to provide the second output signal 6 to be supplied to the discriminator 7 through the conductors 6'. The duration of the time needed by the ball 22 for traversing the distance in the cavity 23 until it closes the circuit through the contact 27*a*, 27*b* is evaluated by the discriminator as a detonating condition for the detonator 13.

The sensitivity of the sensor 2 as shown in quite satisfactory for most practical purposes. However, it is possible to further increase the sensitivity of the sensor 2 by providing in the housing 21 along the cavity 23 optical or inductive sensing members for sensing in the acceleration dependent movement of the mass 22. A still further improvement in the sensitivity or measuring accuracy of the sensor 2 may be achieved by dividing the mass 22 into two or more partial masses which may be released independently of each other.

The main advantage achieved by the invention is seen in that the present method and system may be realized by simple and hence inexpensive components while simultaneously assuring a precise sensing or ascertaining of a reversing point in the flight direction 28 of a dual stage weapon including a follow-up charge for determining the applicable detonating condition.

FIG. 3 shows a modification of the sensor 2 which has a two stage release. The first release stage is realized by the cutter 25 operated as described above. The second release stage is realized by locking bars 30 and 31 which are moved out of respective locking grooves 30' and 31' as indicated by the respective arrows, for example, in response to the operation of a solenoid not shown, but energized by a signal provided with a predetermined delay after the signal 5 has been applied for igniting the charge 26. Incidentally, the portion of the screw 24 which after severing remains attached to the ball 22 forms a portion of the mass which participates in the senCsing of the rebound acceleration.

FIG. 4 shows an example for the discriminator or detector 7 of FIG. 1. An impulse counter 7*a* is started, for example, by a signal 5 from the output of the delay circuit 4' which also triggers the release of the mass 22 in FIG. 2. Thus, such mass release and the starting of the counter 7*a* shall take place coincidentally. The counter 7*a* is stopped by the signal 6 provided when the mass 22 closes the contacts 27*a*, 27*b*. The output of the counter 7*a* is connected to a comparator 7*b* which provides the output signal 8 to the OR-gate 8' when the number of pulses counted until the stop signal is received remains below a value stored in the comparator 7*b*. In that case the detonator 13 is triggered substantially instantaneously. On the other hand, if the number of pulses counted between start and stop exceeds a predetermined value stored in the comparator 7*b*, an output signal 9 is provided which is supplied as the clock signal to an input of the random function generator 10 shown in FIG. 5. Incidentally, the signal 5 for starting the counter 7*a* may also be derived from the severing of the screw bolt 24 as a result of the pyrotechnical release of the screw bolt. This feature would avoid any delay between the ignition of the charge 26 and the actual severing.

The counter 7*a* may, for example, be operated with a pulse frequency of 5 kHz. Thus, if the counter than counts 100 pulses between start and stop, the time duration for the mass 22 to reach the contacts 27*a*, 27*b* would be 20 msec, for example.

Figure 6:
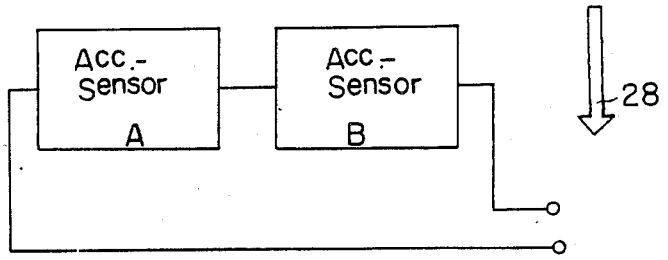
FIG. 6 shows a first and a second acceleration sensor connected in series with each other.
Figure 7:
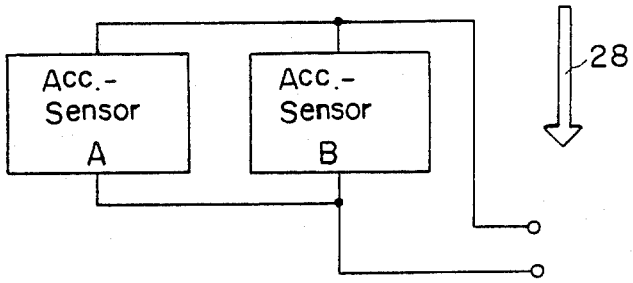
FIG. 7 shows the first and second acceleration sensors connected in parallel with each other.

The random function generator 10 shown in FIG. 5 is of conventional construction and comprises, for example, a shit register 40 provided with multiple feedback circuits 41, 42 including exclusive OR-gates as shown. One input of the shift register 40 receives the signal 9 from the respective output of the detector 7 or comparator 7*b*. The other input receives the signal 3' from the sensor 3. The shift register 40 varies the stored binary value in a pseudo-random manner after each input of the signal 9. Outputs of the shift register 40 are connected to the input of an AND-gate 12' which provides at its output the signal 12 to the OR-gate 8'. The arrangement of the logic circuit means may be such that the output signal 12 is provided in response to a value recognition on an average for each fifth "word" resulting in a coincidence at the AND-gate 12'. With regard to the signal 3' the shift register 40 provides an able/disable condition for passing on the signal 3' of the sensor 3 to function as a trigger signal for the detonator 13. FIGS. 6 and 7 are self-explanatory. The series connection of the first and second accleration sensors in FIG. 6 and the parallel connection of these sensors in FIG. 7 provide a certain redundancy.

Although the invention has been described with reference to specific example embodiments, it will be appreciated, that it is intended to cover all modification and equivalents within the scope of the appended claims.

What is claimed is:

1. A method for detecting different detonating conditions for a follow-up explosive charge in a dual stage weapon containing a primary explosive charge and said follow-up explosive charge, comprising the following steps:

(a) using an initially unlocked first acceleration sensor having relatively low sensitivity in said dual stage weapon for producing an acceleration representing first output signal, (b) delaying said first output signal for an adjustable length of time to provide a delayed first output signal, (c) releasing with said delayed first output signal a locking means of a second initially locked second acceleration sensor having a relatively high sensitivity compared to said relatively low sensitivity of said first acceleration sensor, (d) producing with said released second acceleration sensor an acceleration representing second output signal, (e) detecting in a signal discriminator circuit from said second output signal detonating condition representing signal, and (f) using said detonating condition representing signal for activating a detonator of said follow-up explosive charge.

2. The method of claim 1, further comprising:

(a) providing third acceleration sensor means for generating an acceleration or vibration representing third output signal, (b) supplying said third output signal to a random function generator for generating a random activating signal, (c) supplying said detonating condition representing signal as a clock signal also to said random function generator for passing said random activating signal, and (d) supplying said random activating signal and said detonating condition representing signal through logic circuit means to said detonator of said follow-up explosive charge for activating said detonator with one of said random activating signal and said detonating condition representing signal.

3. The method of claim 2, further comprising using for any one of said first, second, and third acceleration sensor means two acceleration sensing members arranged in parallel.

4. The method of claim 2, further comprising using for any one of said first, second, and third acceleration sensor means two acceleration sensing members arranged in series.

5. A system for detecting different detonating conditions for a follow-up explosive charge in a dual stage weapon containing a primary explosive charge and said follow-up explosive charge, said system comprising:

(a) initially unlocked first acceleration sensor means having a relatively low sensitivity in said dual stage weapon for producing an acceleration representing first output signal, (b) time delay means operatively connected to said first acceleration sensor means for delaying said first output signal for an adjustable length of time to provide a delayed first output signal, (c) second acceleration sensor means including a locking means for initially locking said second acceleration sensor means having a relatively high sensitivity compared to said relatively low sensitivity of said first acceleration sensor means, said second acceleration sensor means being operatively connected to said time delay means for releasing said locking means with said first output signal after its delay, (d) said second acceleration sensor means producing an acceleration representing second output signal upon release of said locking means, (e) discriminator circuit means operatively connected to said second accleration sensor means for detecting from said second output signal a detonating condition representing signal, and (f) detonator means operatively connected to said signal discriminator circuit means for activating said follow-up explosive charge by triggering said detonator means.

6. The system of claim 5, further comprising:

(a) third acceleration sensor means for generating an acceleration representing third output signal, (b) a random function generator operatively connected to receive said third output signal for generating a random activating, signal, (c) means operatively connecting said random function generator to said signal discriminator circuit means for supplying said detonating condition representing signal as a clock signal to said random function generator for producing said random activating signal, and (d) logic circuit means operatively connecting said random function generator and said signal discriminating circuit means to said detonator means for supplying said activating signal and said detonating condition representing signal to said detonator means for activating said detonator means with one of the activating signal and said detonating condition representing signal.

7. The system of claim 6, wherein at least one of said first, second and third acceleration sensor means comprises two acceleration sensing members arranged in parallel for providing a certain redundancy.

8. The system of claim 6, wherein at least one of said first, second, and third acceleration sensor means comprise two acceleration sensing members arranged in series for providing a certain redundancy.

9. The system of claim 5 wherein said first acceleration sensor means comprises a further output for providing a direct output signal, said system further comprising conductor means directly connecting said further output of said first acceleration sensing means to said signal discriminator circuit means for detecting from said direct output signal of said first acceleration sensor means said detonating condition representing signal.

10. The system of claim 5, wherein said second acceleration sensor means having a relatively high sensitivity, comprise housing means forming a cavity having a central axis defining a sensing direction, acceleration sensing mass means, mounting means releasably mounting said sensing mass means in said cavity of said housing means, releasing means operatively arranged for cooperation with said mounting means for releasing said sensing mass means for movement in said cavity of said housing means in said sensing direction upon release of said sensing mass means, and switch means operatively arranged in said housing means in a position for actuation of said switch means by said sensing mass means after said sensing mass means has moved through a predetermined distance in said sensing direction in said cavity.

11. The system of claim 10, wherein said first and second acceleration sensor means further comprise pick-up means operatively arranged in said housing means for detecting the movement of said sensing mass means in said cavity of said housing means.

12. The system of claim 10, wherein said releasing means comprise a cutting member operatively arranged for severing said mounting means, and force applying means arranged for applying a severing force to said cutting means.

13. The system of claim 12, wherein said force applying means comprise an explosive charge for driving said cutting member through said mounting means.

14. The system of claim 10, comprising further releasing means operatively arranged for cooperation with said mounting means for releasing said sensing mass means after said first sensor means have already released said sensing mass means.

15. The system of claim 10, wherein said mounting means at least partially form part of said sensing mass means, whereby said sensing mass means comprising two partial mass components which are connected to each other.

* * * * *